United States Patent [19]

McGready

[11] Patent Number: 4,601,101

[45] Date of Patent: Jul. 22, 1986

[54] RAZOR SYSTEM

[75] Inventor: Angus J. McGready, Reading, England

[73] Assignee: Wilkinson Sword Limited, High Wycombe, England

[21] Appl. No.: 708,304

[22] Filed: Mar. 5, 1985

[30] Foreign Application Priority Data

Mar. 14, 1984 [GB] United Kingdom ..... 8406683

[51] Int. Cl.[4] ..... B26B 21/24

[52] U.S. Cl. ..... 30/40.2; 30/40; 30/125

[58] Field of Search ..... 30/40, 40.2, 125

[56] References Cited

U.S. PATENT DOCUMENTS

| | | | |
|---|---|---|---|
| 1,712,668 | 5/1929 | Hope | 30/125 X |
| 1,734,394 | 11/1929 | Muros | 30/40 |
| 1,877,429 | 9/1932 | Rodrigues | 30/40 |
| 2,572,925 | 10/1951 | Gray | 30/40 |
| 2,698,482 | 1/1955 | Aguirregaviria | 30/40 |
| 2,725,626 | 12/1955 | Baker | 30/40 |
| 2,857,667 | 10/1958 | DeBaun | 30/40 |
| 2,893,118 | 7/1959 | Lewis | 30/40 |
| 3,388,831 | 6/1968 | Hansom | 30/40.2 |

FOREIGN PATENT DOCUMENTS 19801 of 1910 United Kingdom .

*Primary Examiner*—Jimmy C. Peters
*Attorney, Agent, or Firm*—John K. Williamson

[57] ABSTRACT

A razor system comprises a handle 10 to which a blade unit 15 can be connected by a releasable coupling, the razor handle being hollow and containing a dispenser in which a plurality of blade units are stored for attachment in turn to the handle when the blade unit, previously fitted in an operative position on the end of the handle, has been discarded. The releasable coupling 13 is a pair of resilient claws 13*a* engageable by snap action in a pair of recesses in the blade unit for pivotally mounting the blade unit on the handle, the blade units being slidable longitudinally out of the dispenser.

10 Claims, 12 Drawing Figures

RAZOR SYSTEM

BACKGROUND OF THE INVENTION

This invention relates to a razor system, and in particular to a razor handle to which a blade unit can be attached for use until the cutting edge of this blade or each blade of the unit has become dull. Thereafter the blade unit can be removed and replaced with a new blade unit.

By the expression 'blade unit' as used herein is meant a blade, or two or more blades disposed in side-by-side parallel-spaced relationship, mounted in a holder normally of plastics material. The holder can, and usually does, include a guard bar and top cap so positioned relative to the cutting edge of the or each blade as to give a desired blade exposure or blade geometry.

The razor handle can be engaged with a blade unit by causing the blade unit to be slid into a trough-shaped support track on the handle, or by providing a pair of claw-shaped pivot members on the handle which can be snapped together or moved apart by a spring-biassed operating mechanism in the handle to engage or disengage cooperating pivot recesses in the blade unit. A blade unit secured to such a handle can pivot about an axis parallel to the or each blade cutting edge. Certain blade units which have been offered for sale are provided both with grooves for engagement with a track-type handle and with pivot recesses for engagement with a handle of the pivot-claw type referred to above.

Such blade systems are well known but tend to be cumbersome or heavy, particularly when the handle is of the pviotal mounting type, and particularly when the replacement blade units and used blade units are carried in a separate dispenser containing six or more blade units.

BRIEF SUMMARY OF THE INVENTION

According to the present invention there is provided a razor system comprising a razor handle and coupling means on the handle for releasably securing the handle to a blade unit to form an operative razor, the blade unit comprising one or more razor blades permanently secured in a blade support, and a dispenser containing a plurality of blade units the dispenser being removably contained within said handle.

According to another aspect the present invention provides a razor system comprising a razor handle and coupling means on the handle for releasably securing the handle to a blade unit to form an operative razor, the blade unit comprising one or more razor blades permanently secured in a blade support, the coupling means comprising a first pair of pivot members movable towards and away from each other for releasable engagement with a cooperative pair of pivot members on the blade unit to connect the blade unit to the handle for pivotal movement about an axis parallel to the cutting edge of the or each blade, and a dispenser containing a plurality of blade units, wherein said first pair of pivot members are resiliently engageable with and disengageable from the pivot members of the blade unit by movement of the handle in a plane perpendicular to the length of the blade unit, and each blade unit is removable from the dispenser by movement of the unit in the direction of its length.

The invention will now be particularly described, by way of example only, with reference to the accompanying drawings in which:

DETAILED DESCRIPTION

Figure 1:
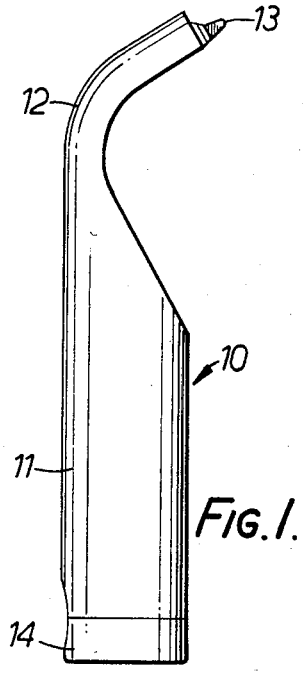
FIG. 1 is a side elevation of a preferred form of razor system according to the invention.
Figure 2:
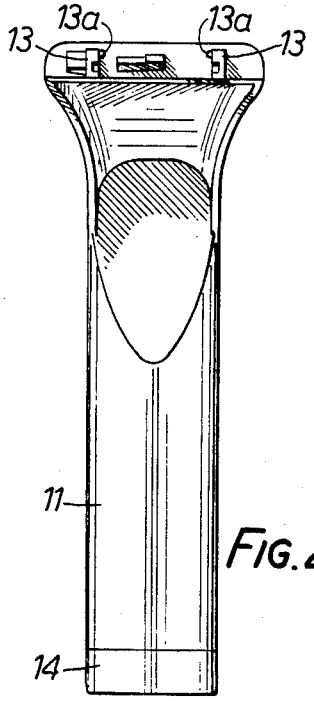
FIGS. 2, 3 and 4 are respectively a front elevation, rear elevation and lower end elevation of the razor system of FIG. 1.
Figure 3:
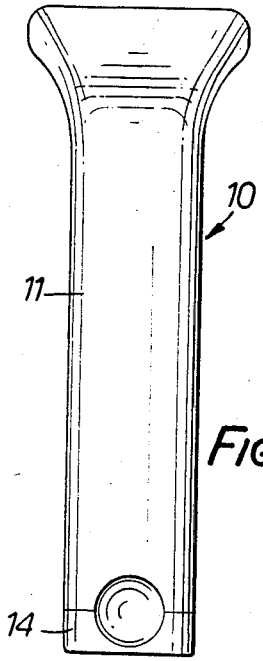
Figure 4:
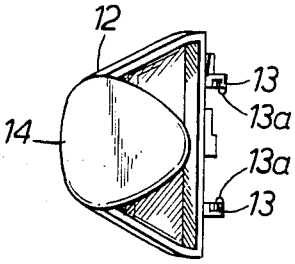

As shown in FIGS. 1 to 6, the first embodiment of razor system comprises a razor handle 10 having a generally cylindrical hollow hand grip portion 11 which leads via a neck portion 12 to a blade unit support 13 at the upper end of the handle. The opposite end of the handle is provided with a removable cap portion 14.

The blade unit support 13 is shaped according to the means formed on the blade unit for attaching it to the blade unit support 13. In the preferred embodiment of FIGS. 1 to 6, the blade unit support 13 comprises a pair of resilient claws 13*a* formed of plastics material integrally with the handle and adapted to engage in a snap fit in corresponding recesses 15*c* in webs 15*a* on the rear side of a blade unit 15. In this way the blade unit 15 is supported on the handle 10 for pivotal movement of the blade unit about an axis parallel to the cutting edge of the or each blade.

Although the support 13 has been illustrated in the form of claws for engagement in recesses of the blade unit, if the blade unit were formed with pin-like projections, the claws 13*a* would be shaped with corresponding recesses to receive such projections.

Figure 5:
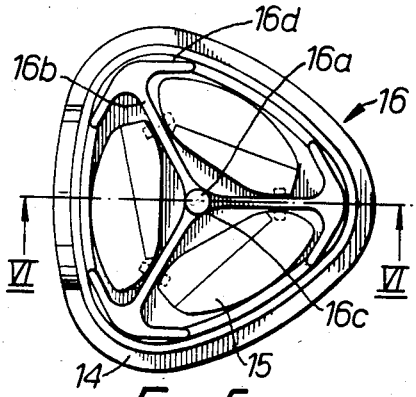
FIG. 5 is an end view of the dispenser.
Figure 6:
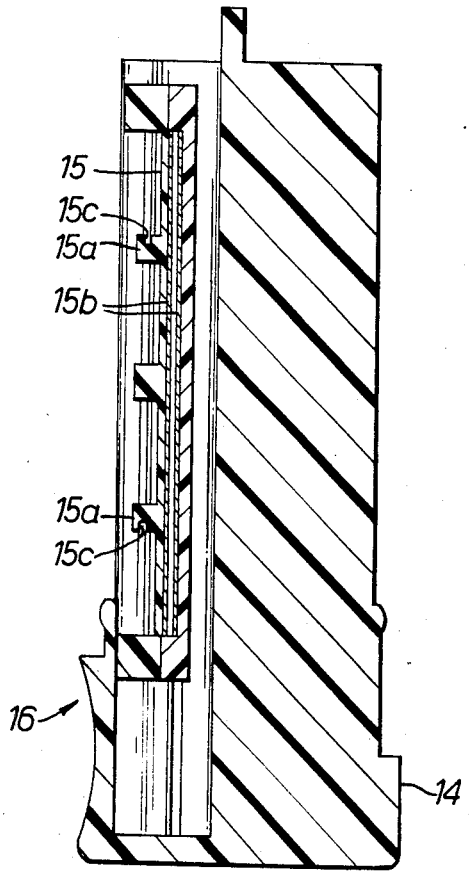
FIG. 6 is a section on the line VI—VI of FIG. 5.
Figure 7:
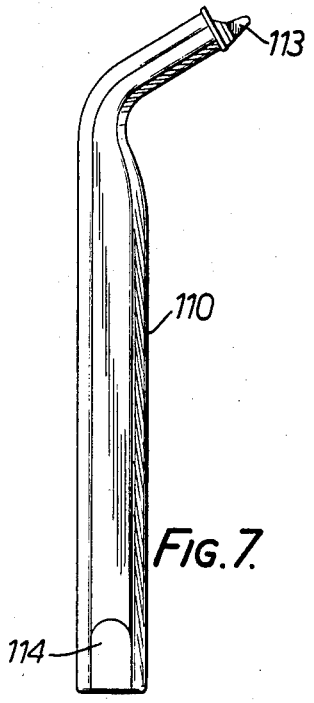
FIGS. 7–10 are respectively a side elevation, front elevation, rear elevation and lower end elevation of a second embodiment of the razor system.
Figure 8:
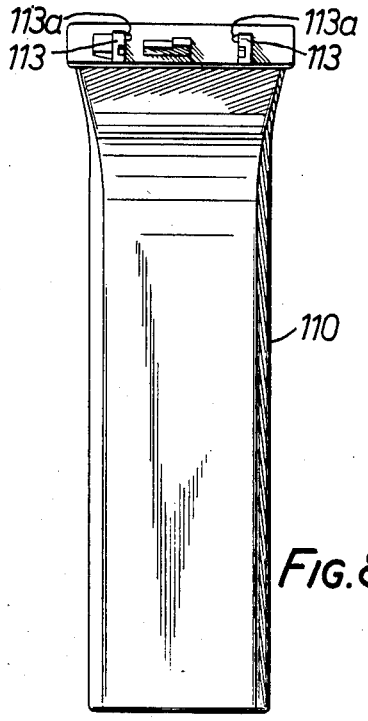
Figure 9:
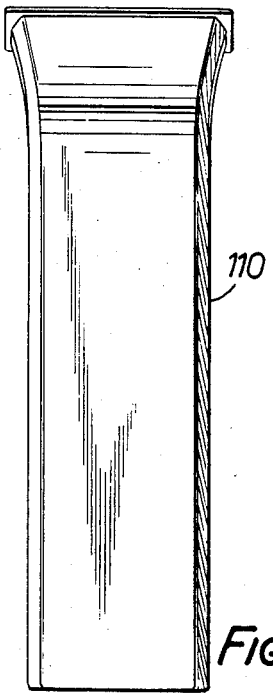
Figure 10:
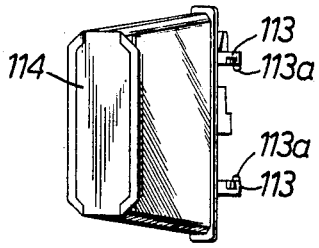
Figure 11:
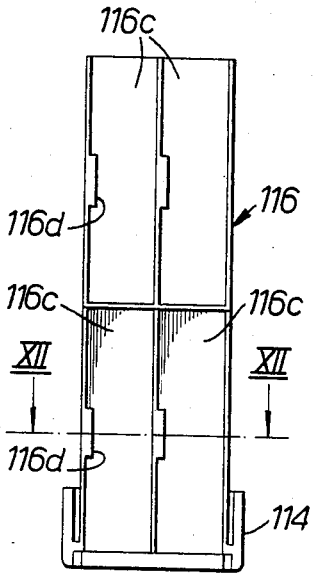
FIGS. 11 and 12 are respectively a plan view and a longitudinal section of the dispenser of a second embodiment of the razor system.
Figure 12:
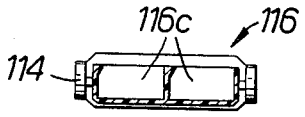

A blade unit dispenser or magazine 16 shown in FIGS. 5 and 6 comprises the end cap 14 of the handle which is of cylindrical shape and from which a central core 16*a* extends axially. The central core is integral with, for example, three radial lobes 16*b*, defining between them three compartments 16*c* each for receiving a separate blade unit, each compartment being open at one end. The radial outer end of each lobe supports a rail or one or more rail portions 16*d* on its circumferentially-opposite faces, each rail or rail portion cooperating with the opposite rail or rail portion of the next adjacent lobe to grip a blade unit 15 between them.

In order to change a blade unit 15 in the illustrated system after the, or each, blade 15*b* (FIG. 6) of the unit has lost its sharpness, the dispenser 16 is first pulled out of the razor handle by gripping and withdrawing the end portion 14 of the handle. After disposing of the used blade unit, the razor is moved towards the blade unit in a plane perpendicular to the length of the blade unit until the claws 13*a* of the razor handle are brought into engagement with the corresponding pivot recesses 15*c* in the rear of one of the new blade units in a snap fit. The new blade unit is thereafter drawn out of the dispenser by the handle and by pulling the blade unit in the direction of its length through the open end of the compartment.

The blade unit attached to the razor handle can, when necessary, be disposed of by inserting it into an empty compartment of the dispenser 16 or can be removed manually if, as commonly happens in other razor systems, the razor is sold with a dummy (i.e. bladeless) unit in position on the handle.

It will be understood that in known dispensers the blade units are normally held by detents attached to the resilient walls of the compartment to overlie the blade units so that the blade unit, after attachment to the handle, must be pulled out of the compartment in a direction perpendicular to its length. For this reason, the claws of a claw-type blade support have to lock on to a blade unit in the closed position of the claws and yet be manually separable when it is desired to release the blade unit from the razor handle.

In contrast, in the preferred embodiment of the present invention, the compartments are open at one end and the handle is therefore provided with integrally formed resilient claws whose stiffness need only be sufficient to grip the blade unit and move it lengthwise. The stiffness does not have to overcome the resistance of the detents of the usual dispenser. A simple handle such as this avoids the cost, weight and complexity of the normal locking claw type handle.

In the embodiment of FIGS. 7 to 12, the razor handle 110 is of generally rectangular cross-section and is formed with a claw-type blade unit support 113 having claws 113*a*. The handle houses a rectangular section dispenser 116, which is arranged like a drawer within the handle. The dispenser in this case is formed with, for example, four co-planar compartments 116*c* arranged in two rows each of two compartments, and coplanar with the rectangular-section end cap 114 of the handle. In this case, the attachment of the blade unit to the handle is effected by moving the handle up to the blade unit as described above in relation to the first embodiment and causing the claws to lock resiliently into the claw recesses in the back of the blade unit 15 (see the blade unit of FIG. 6). Thereafter the blade unit is pulled longitudinally out of the dispenser against the sliding resistance of a detent 116*d* on one of the long walls of the compartment.

Each compartment is open at at least one end, and if necessary the first two compartments remote from the cap 114 can be hinged to the second two compartments to facilitate removal of the blade units from the second two compartments.

Although the preferred forms of the invention has been described above in relation to a claw-type handle, a simple form of the system can be provided in which the blade unit is secured to the handle by means of a track-type support on the handle fitting within a channel in the blade unit, or vice versa.

I claim:

1. A razor system comprising a blade unit, a razor handle and coupling means on the handle for releasably securing the handle to the blade unit to form an operative razor, the blade unit comprising a blade support and at least one razor blade permanently secured in the blade support, and a dispenser containing a plurality of blade units, the dispenser being removably contained within said handle wherein each blade unit is removable from the dispenser by longitudinal sliding movement, and the coupling means comprise a pair of first pivot members resiliently movable towards and away from each other, the blade unit having a cooperative pair of second pivot members for engagement by said first pivot members to connect the blade unit to the handle for pivotal movement about an axis parallel to the cutting edge of the or each blade.

2. A razor system according to claim 1 wherein the first pivot members of the handle are adapted to make snap-fit engagement with the second pivot members of the blade unit as a result of movement of the handle toward the blade unit in a direction approximately perpendicular to the length of the blade unit.

3. A razor system according to claim 1 or claim 2 wherein the first pivot members are formed integrally with the handle from plastics material.

4. A razor system according to claim 1 wherein a part of the handle which is removable from the remainder of the handle forms an integral part of the blade unit dispenser.

5. A razor system according to claim 1 wherein the dispenser comprises a central core from which lobes extend radially, each pair of adjacent lobes defining between them a compartment for containing a blade unit.

6. A razor system according to claim 5 wherein each pair of adjacent lobes comprises a pair of spaced rails between which a blade unit can be supported.

7. A razor system according to claim 1 wherein the dispenser is of rectangular section and forms a drawer slidable into and out of the razor handle.

8. A razor system comprising a blade unit, a razor handle and coupling means on the handle for releasably securing the handle to the blade unit to form an operative razor, the blade unit comprising a blade support and at least one razor blade permanently secured in the blade support, the coupling means comprising a first pair of pivot members movable towards and away from each other, the blade unit further comprising a pair of pivot members on the blade unit cooperative with the first pair of pivot members for releasably connecting the blade unit to the handle for pivotal movement about an axis parallel to the cutting edge of the or each blade, and a dispenser containing a plurality of blade units, wherein said first pair of pivot members are resiliently engageable with and disengageable from the pivot members of the blade unit by movement of the handle in a plane approximately perpendicular to the length of the blade unit, and each blade unit is removable from the dispenser by movement of the unit in the direction of its length.

9. A razor system comprising a razor handle, coupling means rigidly secured on the handle for releasably securing the handle to a blade unit to form an operative razor, the blade unit comprising at least one razor blade permanently secured in a blade support, the blade having a cutting edge and the blade support having a forward side adjacent the cutting edge of the blade and a rearward side remote from said cutting edge, the blade unit having, on said rearward side, unit-supporting means adapted for interengagement with said coupling means, the system further comprising a blade-unit dispenser removably mounted in said handle, said dispenser containing a plurality of said blade units so disposed within the dispenser that said rearward side of each blade unit is exposed for engagement with the coupling means of the handle when the dispenser is withdrawn from the handle.

10. A razor system according to claim 9 wherein said dispenser has a plurality of radially-extending lobes defining therebetween compartments each shaped to receive a said blade unit and retain it within the dispenser until removed by the handle following engagement therewith.

* * * * *